US006114963A

United States Patent [19]

Blake et al.

[11] Patent Number: 6,114,963

[45] Date of Patent: Sep. 5, 2000

[54] PORTAL MONITORING AND ALARM SYSTEM

[76] Inventors: Whitney Blake, 55 Revere Rd., Manhasset, N.Y. 11030, by Joseph P. Blake, Jr., natural guardian; Lazaros Pavlidis, 52 North Dr., Manhasset Hills, N.Y. 11040-2255

[21] Appl. No.: 09/421,761

[22] Filed: Oct. 19, 1999

[51] Int. Cl.[7] ..... G08B 23/00

[52] U.S. Cl. ..... 340/573.4; 340/556; 340/522; 340/521; 340/551; 340/571; 340/555; 340/557; 340/540

[58] Field of Search ..... 340/573.4, 556, 340/522, 521, 551, 571, 555, 557, 540

[56] References Cited

U.S. PATENT DOCUMENTS

| | | | |
|---|---|---|---|
| 4,698,702 | 10/1987 | Miyake | 360/33.1 |
| 4,701,751 | 10/1987 | Sackett . | |
| 4,910,498 | 3/1990 | Feher . | |
| 5,255,301 | 10/1993 | Nakamura et al. . | |
| 5,315,285 | 5/1994 | Nykerk | 340/426 |
| 5,554,972 | 9/1996 | Byrne . | |
| 5,568,121 | 10/1996 | Lamensdorf | 340/539 |
| 5,625,340 | 4/1997 | Gustavsson . | |
| 5,748,087 | 5/1998 | Ingargiola et al. | 340/573 |
| 5,757,274 | 5/1998 | Slomowitz et al. . | |
| 5,774,055 | 6/1998 | Pomerantz | 340/573 |
| 5,793,291 | 8/1998 | Thornton . | |
| 5,831,527 | 11/1998 | Jones, II et al. . | |
| 5,844,487 | 12/1998 | Britt . | |

*Primary Examiner*—Daniel J. Wu
*Assistant Examiner*—Tai T. Nguyen
*Attorney, Agent, or Firm*—Gene Scott-Patent Law & Venture Group

[57] ABSTRACT

A set of sensors or sensor pairs capable of detecting the presence of a person passing through a portal is used for monitoring the portal. In one embodiment the portal has spaced apart upright supports. On one of the upright supports is mounted the sensors and the other upright support is used as a surface for reflection of the wave energy transmitted. When a person is present in the portal the person reflects the wave energy. The receiver is capable of detecting the time duration between transmission and receipt of the wave energy signal. In a second embodiment, the sensors are mutually inductively coupled in pairs. When a person is present within the portal the mutual inductance is changed in one or more of the sensor pairs. This change in mutual inductance is sensed and used as a means for determining which person is present in the portal. For example, a family may comprise two adults, a teenager, a preteen and a small child. The use of four sensors enables the system to detect when an adult passes through the portal which causes all four sensors to react due to the superior height of the adult. When three sensor react the system knows that the teenager is present. When two sensors react the system knows that the preteen is present, and when only one sensor reacts, the young child is present. A different alarm reaction is programmed for each instance.

12 Claims, 3 Drawing Sheets

PORTAL MONITORING AND ALARM SYSTEM

BACKGROUND OF THE INVENTION

1. Field of the Invention

This invention relates generally to child safety control systems, and more particularly to such a control system capable of discriminating between the movements of an adult and a small child or baby through a monitored portal.

2. Description of Related Art

The following art defines the present state of this field:

Feher, U.S. Pat. No. 4,910,498 describes an infrared light emitter forming a beam of infrared light directed onto a set of mirrors or reflecting surfaces arranged to form a closed path about a swimming pool and spaced above the pool deck a sufficient amount so as to be intercepted by anyone who might walk through it. After the reflected beam has traversed the closed path about the pool, it then impinges upon a light detector. An electric circuit provides a continuous alarm which can either be sound or visual upon beam interruption and which must be manually reset before it becomes inactive. The monitoring system may be actuated so the operative state by a hand-held radio frequency transmitter. Electrical poser for the system can be a rechargeable battery which is recharged by a solar array mounted directly onto a part of the system obviating the need for interconnecting cable wiring.

Sackett, U.S. Pat. No. 4,701,751 describes an alarm system for a swimming pool or the like whereby small inexperienced children or animals are detected prior to entering the pool or after an unauthorized entry into the water of the pool. The invention comprises the use of a height sensing apparatus employing fiber optics and a logic circuit whereby an interruption of the lowest light path only sounds an alarm. The invention further comprises the use of fiber optics and a movement sensor connected to the optics. Any impact on the water surface of he pool causes the sensor to change the state of the light transmission therethrough by transmitting or interrupting light transmission. This change of normal state activates the alarm. The invention still further comprises a wireless means for detecting a person in the pool water or a man overboard from a ship or the like and sounding an alarm.

U.S. Pat. No. 5,757,274 describes an apparatus for providing an automatic crib gate position indication of a crib having a gate that can be positioned in an open or a closed condition, said apparatus comprising a gate sensor means, having a transmitter, coupled to the crib that wirelessly transmits a first signal indicative of the open condition to a baby monitoring system, the baby monitoring system including a baby unit adjacent the crib and a parent unit remotely-located from the crib and whereby the baby unit wirelessly transmits a second signal indicative of the baby sounds that is received by said parent unit, said first signal being received by said parent unit and controlling a crib gate indication means therein.

Gustavsson, U.S. Pat. No. 5,625,340 describes a device for supervising an area in particular the crossing area between railway gates, in order to detect objects occurring in the area comprises a detector adapted to transmit detection signals and receive their reflection caused by objects. The detector is pivotably arranged in a reciprocal manner so as to transmit the detection signals in an angular area. The detector may be a laser, the light of which forms the detection signals.

Byrne, U.S. Pat. No. 5,554,972 describes an apparatus and method to provide an electronic perimeter warning system to prove the ingress or egress of persons or machines from a selected area such as in an area along the perimeter of a roof under construction. Battery powered signal transmitters and receivers establish a signal beam between two locations. When the continuity of the signal beam is broken, an alarm is sounded to warn the person who is crossing the signal beam of imminent danger.

Nakamura et al., U.S. Pat. No. 5,255,301 describes an apparatus for counting the number of passing persons by stature, wherein a projector is positioned for radiating light toward the head of a passing person, a light receiving lens for receiving light reflected from the person's head and alight position detector are arranged as one set at an upper portion of a gateway or a passageway. The light receiving lens converges reflected light to different light-received positions of the light position detector according to the height of the reflective position. The light position detector outputs electric signals which differ according to the reflected light received at the light-received positions and a counting operation performed discriminately for every output of the signals.

Britt, U.S. Pat. No. 5,844,487 describes an alert alarm responsive to the passage of child unaccompanied by an adult. An adult sensor is placed at an adult height higher than any anticipated child. A child sensor is placed at a height lower than the height of the shortest anticipated child. Actuator circuitry is actuated if a child passes the child sensor within a limited time either before or after the adult passes.

Jones, II et al., U.S. Pat. No. 5,831,527 describes a system to prevent cheating at a casino gaming table, where sensors are strategically positioned about a casino gaming table to monitor the movement about certain established area on the gaming table during certain established times during the play of the game. The tripping of a sensor in response to the detection of unauthorized movement about a certain area of the table sends a signal to a monitoring system which in turn alerts the casino so that the casino may respond to the unauthorized movement accordingly. The system of sensors can be used with a wide variety of card-based or chip-based casino gaming tables.

Thornton, U.S. Pat. No. 5,793,291 describes an alarm system for detection the presence of a person locked in a parked automobile. The alarm system includes a motion detector and a temperature detecting element coupled to a NOR gate. The motion detector transmits a low signal to the NOR gate once it detects motion within the interior of the automobile. The temperature detecting element transmits a low signal to the NOR gate if the temperature in the automobile exceeds a pre-determined extreme temperature. The NOR gate, upon receiving low signals from both the temperature detecting element and the motion detector, transmits an alarm signal.

Slomowitz et al., U.S. Pat. No. 5,757,274 describes a crib gate position indicator for use with a baby crib to automatically alert the parent or infant-caretaker, who is at a location outside of the room or location of the baby crib, when the crib gate has been left in an open condition. Other variations of this crib gate position indicator are used in conjunction with a baby monitoring system, thus supplementing a baby monitoring system with the ability to provide a crib gate position indication, in addition to permitting the parent or infant-caretaker to listen to the sounds being made by the baby.

The prior art teaches clearly teaches a number of distinct techniques for the detection of hazards related to small children and babies. However, the prior art does not teach that a movement alarm may be adapted to sensing the movement of a small child or baby in a manner similar to that of Britt, but with greater security and fail safe control. The present invention fulfills these needs and provides further related advantages as described in the following summary.

SUMMARY OF THE INVENTION

The present invention teaches certain benefits in construction and use which give rise to the objectives described below.

The present invention provides a set of sensors and, or sensor pairs capable of detecting the presence of a person passing through a portal. In one embodiment the portal has spaced apart upright supports. On one of the upright supports is mounted the sensors and the other upright support is used as a surface for reflection of the wave energy transmitted. When a person is present in the portal the person reflects the wave energy. The receiver is capable of detecting the time duration between transmission and receipt of the wave energy signal. In a second embodiment, the sensors are mutually inductively coupled in pairs. When a person is present within the portal the mutual inductance is changed in one or more of the sensor pairs. This change in mutual inductance is sensed and used as a means for determining which person is present in the portal. For example, a family may comprise two adults, a teenager, a preteen and a small child. The use of four sensors enables the system to detect when an adult passes through the portal which causes all four sensors to react due to the superior height of the adult. When three sensor react the system knows that the teenager is present. When two sensors react the system knows that the preteen is present, and when only one sensor reacts, the young child is present.

A primary objective of the present invention is to provide a portal monitor having advantages not taught by the prior art.

Another objective is to provide such a monitor capable of discriminating between individuals of different height and, or mass.

A further objective is to provide such a monitor capable of record and playback of a voice message.

A still further objective is to provide such a monitor using mutual inductance as a means for detecting the passage of an individual through a portal.

An important objective is to provide such a monitor using both wave energy as well as inductance for detecting the passage of an individual through the portal and for determining the identity of said person.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
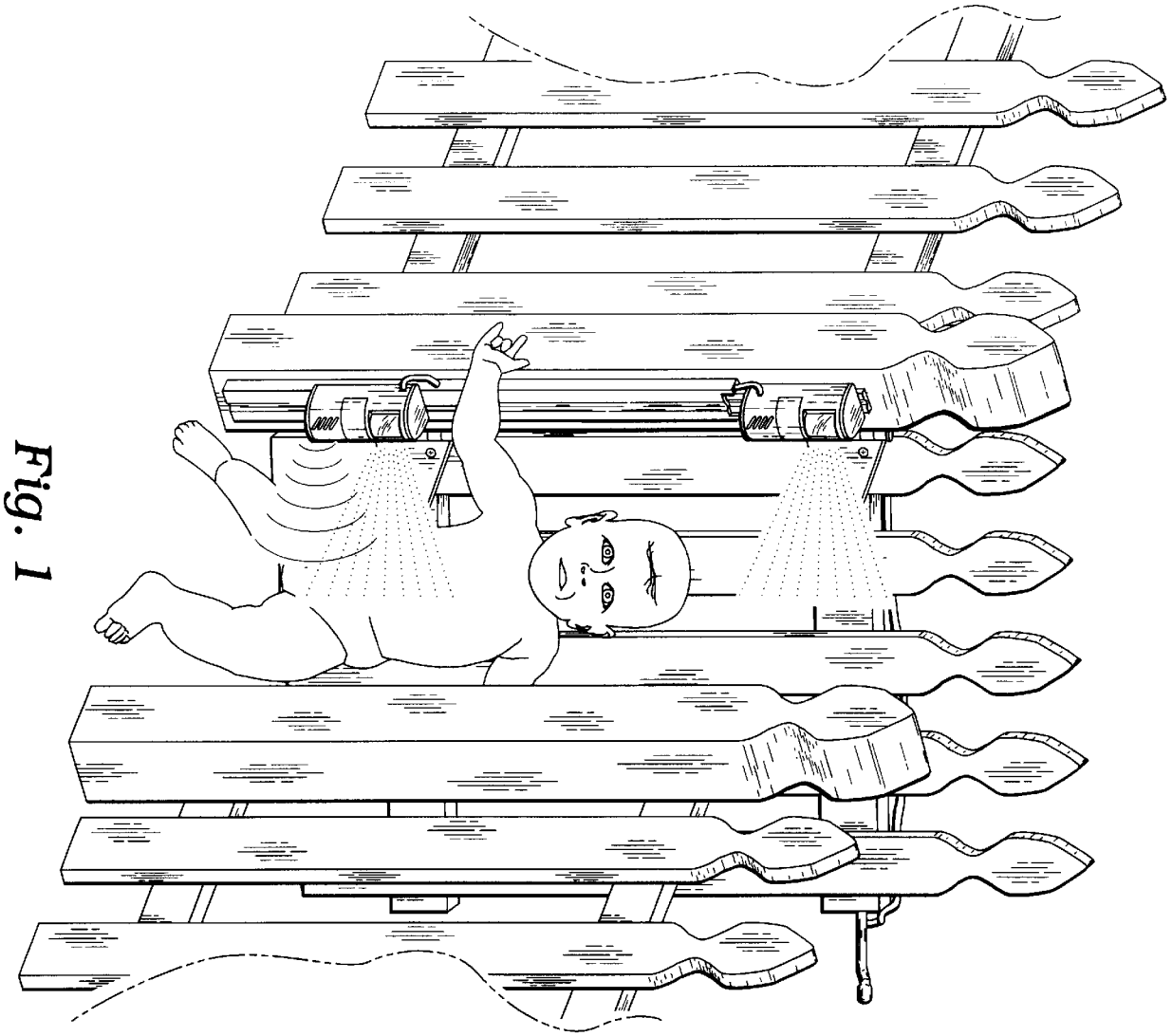
Fig. 1 Prior Art
FIG. 1 is a perspective view of a prior art portal monitoring method.

The prior art teaches, as shown in FIG. 1, that portal may be monitored by two sensors. One of the sensors is placed too high to sense a child, but will sense a taller person in the portal. The other sensor is place low enough for a small child to be detected. A logic circuit is set to call for an alarm condition whenever the lower sensor is activated without the upper sensor being activated either just before, during or after the lower sensor is activated. If an adult passes through the portal both sensors are activated so that no alarm condition is sensed.

Figure 2:
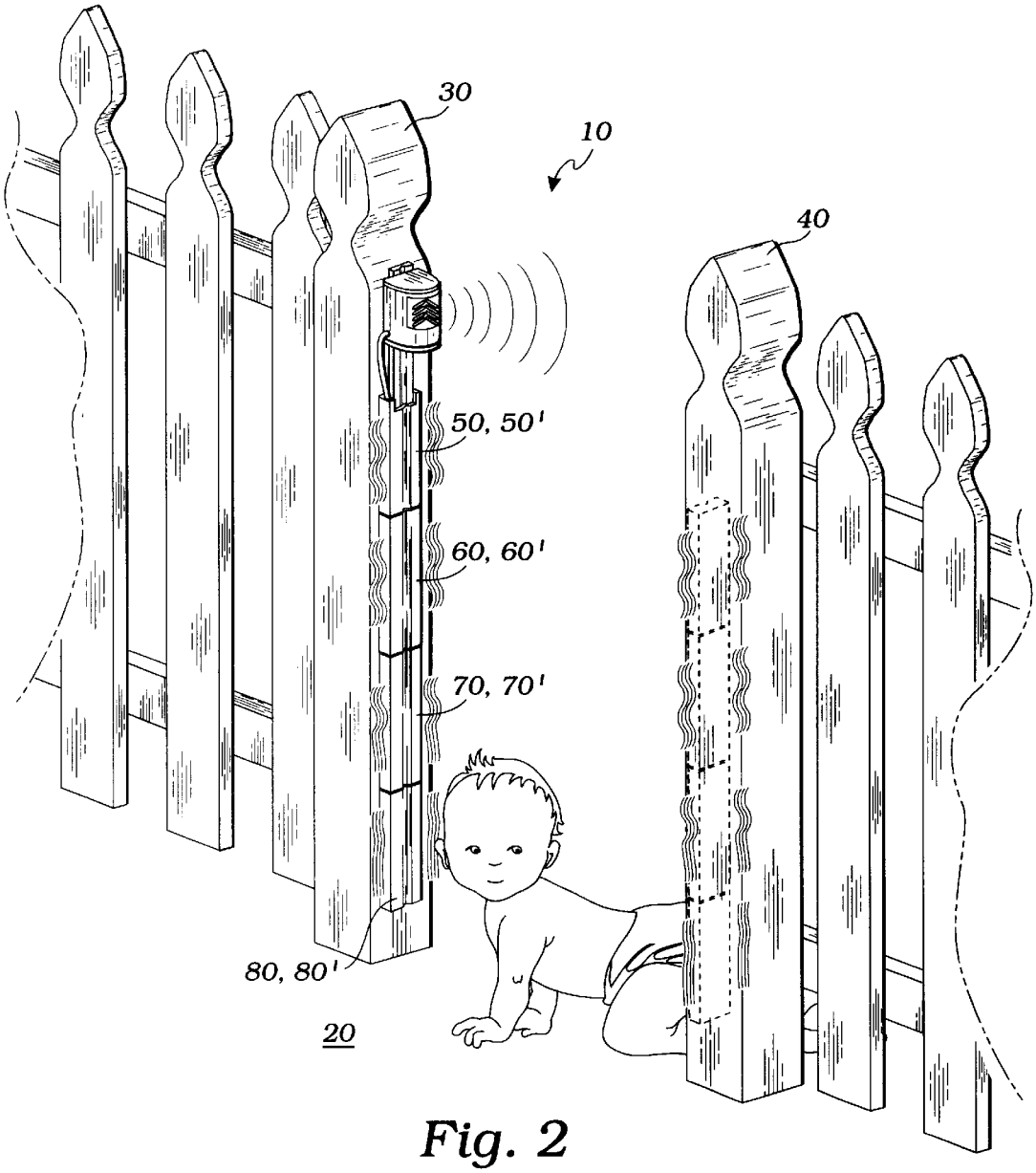
FIG. 2 is a perspective view of the present invention showing the improvement thereof.
Figure 3:
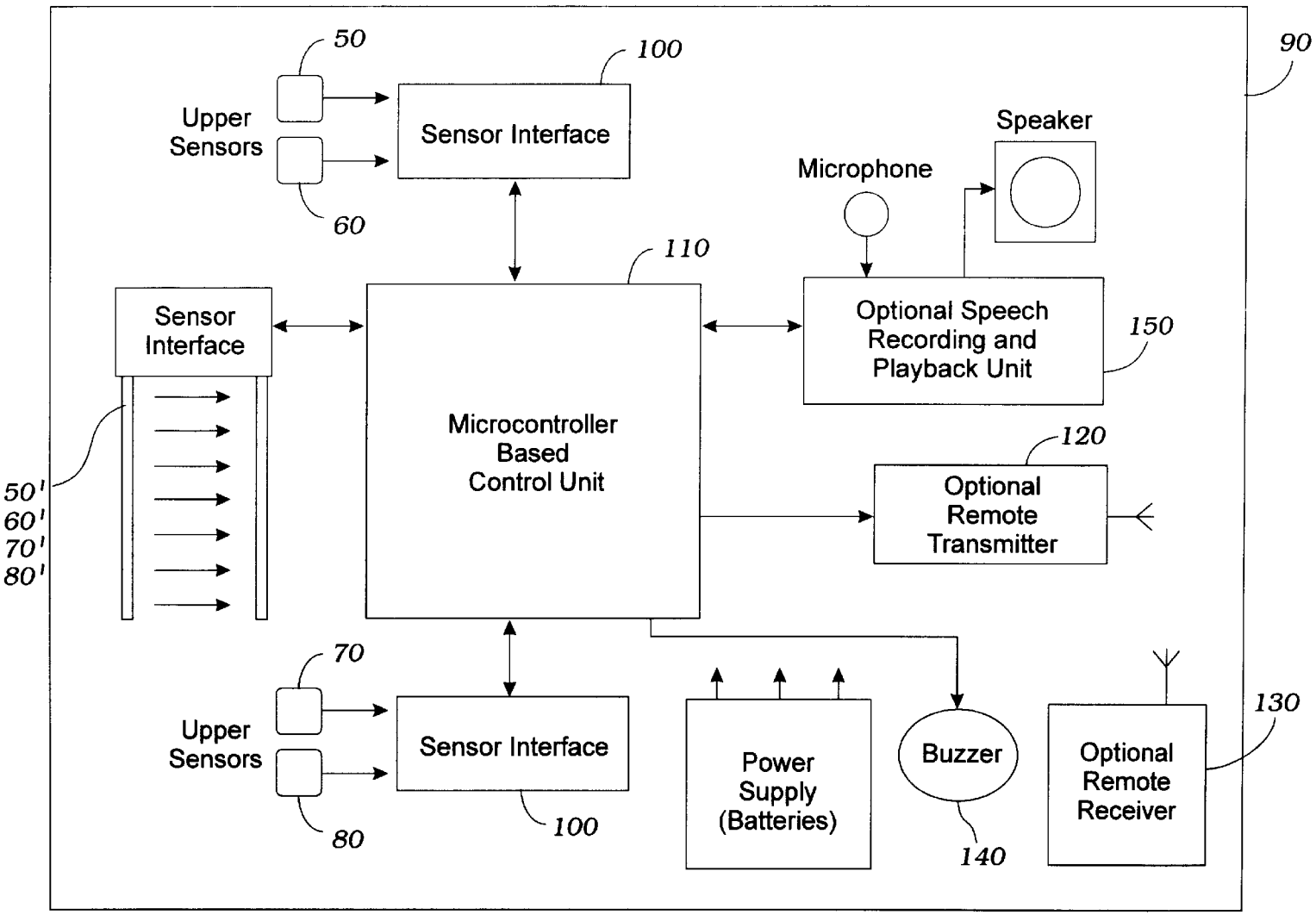
FIG. 3 is a signal block diagram of the two embodiments thereof.

The above described drawings in FIGS. 2 and 3 illustrate the present invention, an apparatus capable of monitoring the movements of persons and discriminating between such persons by physical size and, or mass in order to safeguard small children and babies when a portal may hold a danger for such children. The apparatus, as shown in FIG. 2, comprises a portal 10 providing a walkway surface 20 and a pair of spaced apart upright sensor supports 30, 40 the sensor supports being positioned such that passage of a person through the portal 10 requires moving between the upright sensor supports 30, 40. In a first embodiment, a set of four sensors 50, 60, 70, and 80 are mounted on one of the upright sensor supports 30 in a vertically spaced apart manner as shown, the four sensors are further defined as top 50, upper 60, lower 70 and bottom 80 sensors. The four sensors are positioned for discriminating between persons of varying height so as to determine the identity of a person passing through the portal 10. An electrical circuit 90, shown schematically in FIG. 3, is adapted for receiving signals from the four sensors 50–80 and for processing the signals for identification of the person, and is further adapted for enabling an alarm action, said alarm action being dependent upon the identified person.

In a first embodiment, the four sensors 50–80 are wave energy transceivers each adapted for transmitting a wave energy signal directed laterally between the two upright sensor supports. They are further adapted for receiving a reflected signal from a reflecting surface of the other of the two sensor supports when the wave energy signal is not intercepted by a person present in the portal. When a person is present in the portal the reflected signal from that person is received and the person is identified because of the shorter time between signal transmission and receipt. Alternately, the sensors could use infrared light transmission and reflection.

In an alternate embodiment two sets of four vertically oriented inductive sensors 50', 60', 70', 80' each, are mounted on the upright sensor supports in fixed positions with matched pairs taken from the two sets being placed in physical opposition for establishing an electromagnetic field between them, the field being dependent for its intensity on the mutual inductance of each of the pairs of inductive sensors. The sensors are adapted for discriminating between persons by mass when such persons are positioned between the inductive sensors so as to determine the identity of a person passing through the portal. The electrical circuit, in this embodiment, is adapted for receiving signals from the inductive sensors and for processing these signals for identification of the person and further adapted for enabling an alarm action, said alarm action being dependent upon the identified person.

The inductive sensors are coupled by electromagnetic mutual inductance such that the value of said mutual inductance is different when a person is not present in the portal relative to the value of said mutual inductance when a person is present in the portal, the value of mutual inductance being related to the mass of the person within the portal. It should be noted that a single inductive pair might well be used instead of four sets. When one extended length pair of inductors is used, the mass of the person within the portal is used to determine the nature of the person. But it has been found that a set of four pairs provide an advantage in determining the size as well as the mass of the person. With these two pieces of information, it has been discovered that a relatively high level of discrimination is possible between persons. For instance, the two adults in a family may be about the same height. Or the mother and her teenage child may be about the same height. But with the ability to measure mass, the system is able to determine the mother from the more massive father, or the son from the more massive mother.

The inductive sensors are inductors, i.e., wire wound ferrite cores. When current flows in these two opposing inductors an electromagnetic field is produced and interlocked between the spaced apart inductors such that current flow in one inductor is affected by the field produced by the other inductor. The opposite is true as well. When a person is in the portal, the energy field is disturbed because some energy is absorbed by the person. When this occurs the value of mutual inductance changes and it is this change that may be detected by the circuit in a manner that is well known in the art.

From FIG. 3 it is seen that the sensor or sensor set is interconnected with a sensor interface 100. This interface provides noise filtering, signal strength boosting and analog to digital signal conversion. The digital representation of the original signal is then fed to a microcontroller 110 where data processing is completed. The processor 110 is able to output an alarm signal through a transmitter 120 to a remote receiver 130 so that an alarm signal may be received remotely. For example, the backyard pool gate may be monitored and an alarm signal sent to the kitchen area at the front of the house when an emergency occurs. The processor 110 may alternately simply provide an alarm signal output to a buzzer 140 or other audible alarm, to achieve a local alarm indication. Another possibility is the use of a record and playback machine 150, such as a tape recorder, where the processor 110 enables a prerecorded announcement as a warning. Such an announcement might be, "Warning, a child has entered the pool area."

Clearly, when both types of sensors are used together, the relative height as well as the mass of a person in the portal is determined. This information is useful for determining the identity of a person especially if the height and mass (weight) of each member of a family is provided in a look-up table in the processor 110.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An apparatus capable of monitoring the movements of persons and discriminating between such persons by physical size in order to safeguard small children and babies, the apparatus comprising:

a portal providing a walkway surface and a pair of spaced apart upright sensor supports, the sensor supports being positioned such that passage through the portal requires moving between the upright sensor supports;

a set of two vertically oriented inductive sensors, the sensors being mounted on the upright sensor supports in fixed positions for establishing an electromagnetic field therebetween;

the sensors adapted for discriminating between persons by mass when such persons are positioned between the inductive sensors so as to determine the identity of a person passing through the portal;

an electrical circuit adapted for receiving a signal from the inductive sensors and for processing said signal for identification of the person and further adapted for enabling an alarm action, said alarm action being dependent upon the identified person.

2. The apparatus of claim 1 wherein the inductive sensors are coupled by electromagnetic mutual inductance such that the value of said mutual inductance is different when a person is not present in the portal relative to the value of said mutual inductance when a person is present in the portal, the value of mutual inductance being related to the mass of the person within the portal.

3. The apparatus of claim 1 further comprising an interface circuit connected between the sensors and a signal processor, the interface providing noise filtering, signal strength boosting and analog to digital signal conversion.

4. The apparatus of claim 1 further comprising a transmitter enabled for communication with a remote receiver so that an alarm signal may be received remotely.

5. The apparatus of claim 3 further comprising a local buzzer interconnected with the signal processor to achieve a local alarm indication.

6. The apparatus of claim 3 further comprising a record and playback machine interconnected with the signal processor for playback of a prerecorded announcement as a warning.

7. An apparatus capable of monitoring the movements of persons and discriminating between such persons by physical size in order to safeguard small children and babies, the apparatus comprising:

a portal providing a walkway surface and a pair of spaced apart upright sensor supports, the sensor supports being positioned such that passage through the portal requires moving between the upright sensor supports;

a set of four wave energy sensors mounted on one of the upright sensor supports in a vertically spaced apart manner so that each of the sensors is positioned for sensing only movement adjacent thereto;

a set of two vertically oriented inductive sensors, the sensors being mounted on the upright sensor supports in fixed positions for establishing an electromagnetic field therebetween;

the four wave energy sensors being positioned for discriminating between persons of varying height and the inductive sensors being positioned so as to determine the mass of said persons so as to, together, identify a person passing through the portal;

an electrical circuit adapted for receiving signals from the four sensors and for processing said signals for identification of the person and further adapted for enabling an alarm action, said alarm action being dependent upon the identified person.

8. The apparatus of claim 7 wherein the four sensors are wave energy transceivers each adapted for transmitting a wave energy signal directed laterally between the two upright sensor supports and further adapted for receiving a reflected signal from the other of the two sensor supports when the wave energy signal is not intercepted by a person present in the portal and for receiving the reflected signal from the person when a person is present within the portal.

9. The apparatus of claim 7 further comprising an interface circuit connected between the sensors and a signal processor, the interface providing noise filtering, signal strength boosting and analog to digital signal conversion.

10. The apparatus of claim 8 further comprising a transmitter enabled for communication with a remote receiver so that an alarm signal may be received remotely.

11. The apparatus of claim 8 further comprising a local buzzer interconnected with the signal processor to achieve a local alarm indication.

12. The apparatus of claim 8 further comprising a record and playback machine interconnected with the signal processor for playback of a prerecorded announcement as a warning.

* * * * *